US007807613B2

(12) United States Patent
Rovito et al.

(10) Patent No.: US 7,807,613 B2
(45) Date of Patent: Oct. 5, 2010

(54) AQUEOUS BUFFERED FLUORIDE-CONTAINING ETCH RESIDUE REMOVERS AND CLEANERS

(75) Inventors: Roberto J. Rovito, Quakertown, PA (US); Jennifer M. Rieker, Bethlehem, PA (US); Darryl W. Peters, Stewartsville, NJ (US)

(73) Assignee: Air Products and Chemicals, Inc., Allentown, PA (US)

( * ) Notice: Subject to any disclaimer, the term of this patent is extended or adjusted under 35 U.S.C. 154(b) by 1389 days.

(21) Appl. No.: 10/877,305

(22) Filed: Jun. 25, 2004

(65) Prior Publication Data

US 2004/0266637 A1 Dec. 30, 2004

Related U.S. Application Data

(63) Continuation-in-part of application No. 09/881,552, filed on Jun. 14, 2001, now abandoned.

(51) Int. Cl.
*C11D 7/50* (2006.01)

(52) U.S. Cl. ..... 510/175; 510/176

(58) Field of Classification Search ..... 510/175, 510/176

See application file for complete search history.

(56) References Cited

U.S. PATENT DOCUMENTS 5,211,807 A 5/1993 Yee
5,630,904 A 5/1997 Aoyama et al.
5,792,274 A * 8/1998 Tanabe et al. ..... 134/1.3
5,905,063 A * 5/1999 Tanabe et al. ..... 510/176
5,962,385 A 10/1999 Maruyama et al.
5,968,848 A * 10/1999 Tanabe et al. ..... 438/745
5,972,862 A 10/1999 Torii et al.
6,068,000 A * 5/2000 Tanabe et al. ..... 134/1.3
6,224,785 B1 5/2001 Wojtczak et al.
6,265,309 B1 7/2001 Gotoh et al.
6,372,410 B1 4/2002 Ikemoto et al.
6,399,552 B1 6/2002 Lee et al.
6,492,311 B2 12/2002 Lee et al.
6,627,587 B2 9/2003 Naghshineh et al.
6,638,899 B1 * 10/2003 Wakiya et al. ..... 510/176
6,755,989 B2 6/2004 Wojtczak et al.
6,828,289 B2 * 12/2004 Peters et al. ..... 510/175
6,831,048 B2 * 12/2004 Kezuka et al. ..... 510/175
2004/0016904 A1 1/2004 Baum et al.

FOREIGN PATENT DOCUMENTS

RU 2 065 161 8/1996
WO WO 95/07974 3/1995
WO WO 00/66697 11/2000
WO WO 01/41518 A1 6/2001

* cited by examiner

*Primary Examiner*—Gregory E Webb
(74) *Attorney, Agent, or Firm*—Rosaleen P. Morris-Oskanian; Joseph D. Rossi

(57) ABSTRACT

The invention relates to aqueous, buffered, fluoride containing compositions having a pH of greater than 7.0 to about 11.0. In certain embodiments, the buffered compositions have an extended worklife because pH dependent attributes such as oxide and metal etch rates are stable so long as the pH remains stable.

18 Claims, 5 Drawing Sheets

AQUEOUS BUFFERED FLUORIDE-CONTAINING ETCH RESIDUE REMOVERS AND CLEANERS

CROSS-REFERENCE TO RELATED APPLICATIONS

This application is a continuation-in-part of U.S. patent application Ser. No. 09/881,552, filed 14 Jun. 2001 now abandoned, the disclosure of which is incorporated herein by reference in its entirety.

BACKGROUND OF THE INVENTION

The invention relates to aqueous, buffered fluoride containing compositions having a pH of from greater than 7.0 to about 11.0. These compositions are used as resist and etch or ash residue removers and cleaners in the production of semiconductor devices. The buffered, fluoride containing compositions resist changes in pH and exhibit low corrosive effects on metal films such as aluminum, copper, titanium, tungsten and the like, and low oxide etch rates. More particularly, the invention relates to aqueous, buffered, fluoride containing compositions useful as resist and etch or ash residue removers and cleaners that use molecules not typically viewed as buffers. The buffers of the present invention include the use of a variety of weak acids or protonated bases which act as weak acids in solution that are effective over a pH range of greater than 7.0 to about 11.0. The invention also includes methods of preparing the fluoride containing compositions and their use.

There are a number of fluoride containing compositions disclosed in the art. Torii (U.S. Pat. No. 5,972,862) discloses fluoride containing compositions used as stripper-cleaners. Tanabe (U.S. Pat. Nos. 5,792,274 and 5,905,063) disclose resist remover compositions having a pH of from 5 to 8, containing metal-free salts of HF, a water soluble organic solvent, and optionally a corrosion inhibitor. Maruyama (U.S. Pat. No. 5,692,385) discloses a composition containing from 0.1 wt % to 10 wt % ammonium and alkyl ammonium salts of HF, from 72 wt % to 80 wt % of an organic solvent that is water soluble and the remainder water. According to the teachings in Maruyama, both the fluoride containing compound and the solvent must be present in the given ranges, otherwise the detrimental side effects such as corroding of substrates and poor performance occur. None of the above cited references recognize the effective use of buffers to improve the pH stability of fluoride containing compositions.

BRIEF SUMMARY OF THE INVENTION

A potential negative attribute of acidic fluoride containing compositions is the oxide etch rate. If the oxide etch rate is too high, the fluoride containing compositions may have a limited application for via cleaning since critical dimension control may not be adequate. Raising the pH will usually reduce the oxide etch rate. For instance, it has been shown that raising the pH of a fluoride containing composition to at least 10 can reduce the etch rate of oxide to nearly zero. However at high pH values (>10), metal corrosion and electrogalvanic corrosion of certain metals such as tungsten or titanium can occur. This problem has typically been addressed by adding multiple corrosion inhibitors. The addition of corrosion inhibitors has its drawbacks in that some corrosion inhibitors may interfere with the removal of etch residues. It has been found that adjusting the pH of a fluoride containing composition within a range of from 7 to 9 would balance the effects of oxide etching and etching and corrosion of metals. To minimize or eliminate electrogalvanic corrosion of tungsten, it is necessary to narrow the pH range even further to from 7 to about 8.4. By adding a buffer, one can maintain the pH within predetermined ranges for the fluoride containing compositions. Where metal corrosion or electrogalvanic corrosion is not a concern, the buffered pH range is from greater than 7.0 to about 11.0. Preferably, the range is from greater than 7.0 to about 9.0. In cases where sensitive metals are present, the pH range is from greater than 7.0 to about 8.4. The buffered fluoride containing compositions exhibit reduced pH drift and more consistent etch performance characteristics. Compounds not normally thought of as useful in buffer solutions such as benzotriazole (BZT) are used in the compositions disclosed herein. For example, BZT is best known for its ability to protect copper by forming an oxide-like passivation layer on exposed copper metal. BZT is also known for its ability to chelate with $Cu^{2+}$ in basic solutions, thereby reducing the potential for $Cu^{2+}$ redeposition on wafers. It has also been found that in the aqueous buffered fluoride containing compositions of the invention BZT also provides corrosion protection for exposed titanium.

BZT has a $pk_a$ of 8.38 and the hydrogen on the nitrogen is acidic and can be removed in aqueous solutions. In the compositions disclosed herein, BZT functions both as a weak acid in the buffer and a corrosion inhibitor.

Webster defines a buffer as, "a substance capable in solution of neutralizing both acids and bases and thereby maintaining the original acidity or basicity of the solution." The molar ratio of acid to its conjugate base to provide such a buffering effect, i.e., a molar ratio ranging from 10:1 to 1:10, is well established in the art. See Harris, D. C., *Quantitative Chemical Analysis*, W. H. Freeman and Co., N.Y. (1999), pp. 222-224. Skoog and West, Fundamentals of Analytical Chemistry 3rd Edition, state, "A buffer solution is defined as a solution that resists changes in pH as a result of . . . small additions of acids or bases. The most effective buffer solution contains large and approximately equal concentrations of a conjugate acid-base pair." Buffers are typically thought of as weak acids and the widest buffering range against either an acid or a base which is about one pH unit on either side of the $pk_a$ of the weak acid group. This buffering effect is achieved by having a molar ratio of acid to base ranging from 10:1 to 1:10 or having equimolar concentrations of the acid and the conjugate base;

$$HB <> H^+ + B^-;\ k_a = [H^+][B^-]/[HB],\ \text{when } [B^-]=[HB],\ \text{then } pH = pk_a$$

The conjugate base pair is HB and $B^-$, where $B^-$ is the conjugate base. One can also use a protonated base as the weak acid and achieve a buffered system;

$$BH^+ <> H^+ + B,\ k_a = [H^+][B]/[BH^+],\ \text{when } [B]=[BH^+],\ \text{then } pH = pk_a$$

Here the conjugate acid base pair is $BH^+$ and B, where B is referred to as the conjugate base. Setting the pH is most easily accomplished by having an equimolar ratio of the acid and conjugate base for the acid (or protonated base) with the appropriate $pk_a$. In other embodiments, a buffered system is accomplished by having a molar ratio of acid to base ranging from 10:1 to 1:10.

In certain embodiments, the buffers disclosed herein provide aqueous, fluoride containing compositions that exhibit little or no pH drift on standing overtime, when heated or when diluted with water in amounts up to 95% by weight of the total composition as opposed to unbuffered compositions. An example of pH drift in an unbuffered product over time is shown in FIG. 1. The pH of an unbuffered product composed of dimethylacetamide (DMAC), deionized water, ammonium fluoride and ammonium hydroxide having a pH of 8.3 is monitored over time. As can be seen, the pH decreases from >8 to <4 over a period of seven days with the greatest change occurring within the first two days. The stability of the pH of a composition is important in stripping and cleaning operations because uniform performance characteristics are desirable and the etch rate and metallic corrosion of an unbuffered composition will vary as the pH changes on standing or during use.

DETAILED DESCRIPTION OF THE INVENTION

Figure 1:
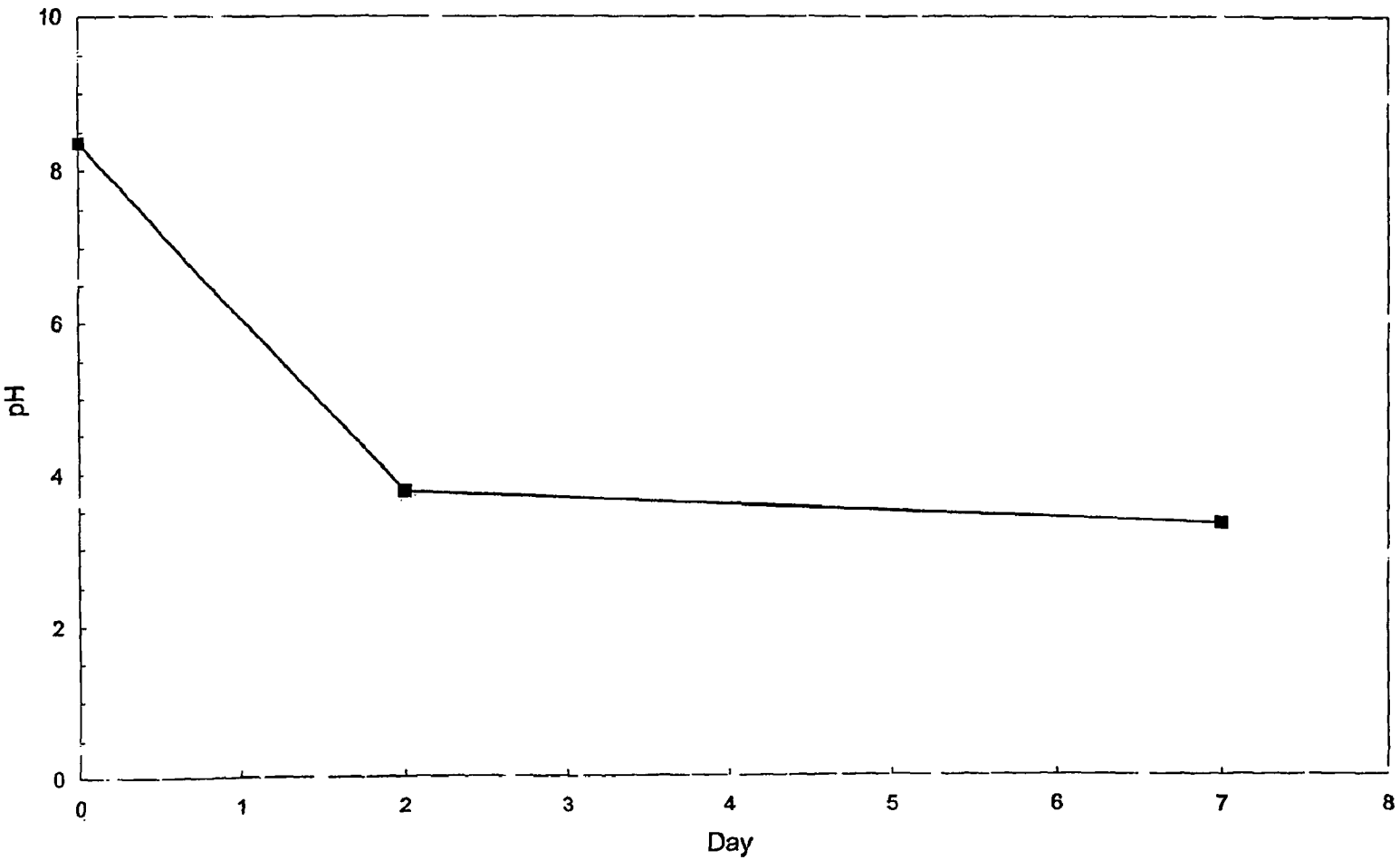
FIG. 1—A graph showing the change in pH on standing of an unbuffered, fluoride containing composition of the type typically used for stripping and cleaning operations.

The invention relates to aqueous, buffered fluoride containing compositions having a pH greater than 7.0 to about 11.0. The compositions are used as resist and etch or ash residue removers and cleaners in the production of semiconductor devices. The aqueous, buffered, fluoride containing compositions have a pH greater than 7.0 to about 11.0 and comprise;

A. a fluoride containing compound of the general formula $R_1R_2R_3R_4NF$ where $R_1$, $R_2$, $R_3$, and $R_4$ are each independently hydrogen, an alcohol group, an alkoxy group, an alkyl group or mixtures thereof, and B. a buffer.

All weight percents are based on the total weight of the aqueous, buffered, fluoride containing composition.

Fluoride is an essential component of the present invention. Fluoride containing compounds include those of the general formula $R_1R_2R_3R_4NF$ where $R_1$, $R_2$, $R_3$, and $R_4$ are each independently hydrogen, an alcohol group, an alkoxy group, an alkyl group and mixtures thereof. Examples of such compositions are ammonium fluoride, tetramethyl ammonium fluoride and tetraethyl ammonium fluoride. Fluoroboric acid can also be used as a fluoride containing composition. The fluoride containing compound or mixture of compounds is preferably present in amounts of from 0.1% by weight to 20% by weight based on the total weight of the composition.

The composition of the invention also includes a buffer. The pH of the composition is adjusted to a desired pH within a range of greater than 7.0 to about 11.0, preferably from greater than 7.0 to about 9.0, most preferably greater than 7.0 to 8.4.

The buffer consists of a conjugate acid-base pair. The acid used is a weak acid, such as a weak organic acid, or protonated base acting as the weak acid in solution. A variety of weak acids or protonated bases are readily available for buffers over a pH range of greater than 7.0 to 11.0. In addition compositions not normally thought of as useful buffers such as benzotriazole, selected biological compositions like glycine and the like can be used. Methods of preparing buffers are well known in the art. The composition of the present invention can be buffered at a desired pH by adding the weak acid or protonated base and the conjugate base in requisite amounts. In one embodiment, a buffer may have a molar ratio of acid to base ranging from 10:1 to 1:10. In an alternative embodiment, the buffer may have equimolar amounts of acid to base or be substantially 1:1. One can also prepare the buffer in situ by adding the weak acid or protonated base and a base in calculated amounts to the fluoride containing composition.

Examples of bases include amines, ammonia, alkylammonium hydroxides, ammonium hydroxide and the like.

Examples of weak acids include HEPES and benzotriazole. Further examples of weak acids such as weak organic acids and protonated bases that can be used in buffers around a pH of 7 or more are listed in Table 1.

TABLE 1

| Substance $pk_a$ |
|---|
| Abietic acid (Sylvic acid) 7.62 |
| A-Alanine, methyl ester 7.74(+1) |
| 2-Aminoacetamide 7.95(+1) |
| 4-Amino-3-bromomethylpyridine 7.47(+1) |
| 2-Aminobutanoic acid, methyl ester 7.64(+1) |
| 1-Aminoisoquinoline 7.62(+1) |
| 4-Aminoisoxazolidine-3-one 7.4(+1) |
| 2-Amino-3-methylpyridine 7.24(+1) |
| 2-Amino-4-methylpyridine 7.48(+1) |
| 2-Amino-5-methylpyridine 7.22(+1) |
| 2-Amino-6-methylpyridine 7.41(+1) |
| 2-Aminoquinoline 7.34(+1) |
| Aspartic diamide 7.00 |
| Aspidospermine 7.65 |
| N,N-Bis(2-hydroxyethel)-2-aminoethane sulfonic acid (BES) 7.15 |
| N-tert-Butyanaline 7.10(+1) |
| 4-Chloro-2-(2'-thiazolylazo)phenol 7.09 |
| Chrome Dark Blue 7.65 |
| Codeine 7.95(+1) |
| 2-Cyanoethylamine 7.7(+1) |
| 2-Cyclohexyl-2-pyrroline 7.91(+1) |
| Diacetylacetone 7.42 |
| 5,5-Diallybarbituric acid 7.78 |
| 1,3-Dichloro-2,5-dihydroxybenzene 7.30 |
| 2,3-Dichlorophenol 7.44 |
| 2,3-Dichlorophenol 7.85 |
| N,N-Diethyl-o-toluidine 7.18(+1) |
| Dihydroergonovine 7.38(+1) |
| 3,4-Dihydroxybenzaldehyde 7.55 |
| 2,6-Dihydroxypurine 7.53 |
| 1,10-Dimethoxy-3,8-dimethyl-4,7-phenanthr- oline 7.21 |
| N,N'-Dimethylethylenediamine-N,N'-diacetic acid 7.40 |
| Dimethylhydroxytetracycline 7.5 |
| 2,6-Dimethyl-4-nitrophenol 7.19 |
| N,N'-Dimethyl-p-toluidine 7.24(+1) |
| Emetine 7.36(+1) |
| Ergometrinine 7.32(+1) |
| Ethyl-2-mercaptoacetate 7.95 |
| 5-Ethyl-5-pentylbarbituric acid 7.96 |
| 5-Ethyl-5-phenylbarbituric acid 7.45 |
| 2-Ethyl-2-pyrroline 7.87(+1) |
| N-Ethylveratramine 7.40(+1) |
| Glycine, ethyl ester 7.66(+1) |
| Glycine hydroxamic acid 7.10 |
| Glycine, methyl ester 7.59(+1) |
| Glyoxaline 7.03(+1) |
| Harmine 7.61 (+1) |
| Heroin 7.6(+1) |
| Hexamethyldisilazane 7.55 |
| 1,2,3,8,9,10-Hexamethyl-4,7-phenanthroline 7.26 |
| 4-Hydroxybenzaldehyde 7.62 |
| 4-Hydroxybenzonitrile (4-Cyanophenol) 7.95 |
| 10-Hydroxycodeine 7.12 |
| N-(2-Hydroxyethyl)piperazine-N'-ethansulfonic acid 7.55 |
| (HEPES) 5-Hydroxy-2-(hydroxymethyl)-4H-pyran-4-one 7.90 |

TABLE 1-continued

| Substance $pk_a$ |
|---|
| 2-Hydroxy-3-methoxybenzaldehyde (o-vanillin) 7.91 |
| 3-Hydroxy-4-nitrotoluene 7.41 |
| Isopilocarpine 7.18(+1) |
| Leucine amide 7.80(+1) |
| Leucine, ethyl seater 7.57(+1) |
| Methoxycarbonylmethylamine 7.66(+1) |
| 4-Methoxy-2-(2'-thiazoylazo)ph- enol 7.83 |
| 2,2'-Methylenebis(4-chlorophenol) 7.6 |
| 1-Methylimidazole 7.06(+1) |
| 4-Methylimidazole 7.55(+1) |
| N-Methylmorpholine 7.13(+1) |
| 4-(Methylsulfonyl)phenol 7.83 |
| Methylthioglycolic acid 7.68 |
| 1-Methylxanthine 7.70 |
| Morphine 7.87(+1) |
| 3-(N-Morpholino)propanesulfonic acid (MOPS) 7.20 |
| 2-Nitrohydroquinone 7.63 |
| 2-Nitrophenol 7.22 |
| 4-Nitrophenol 7.15 |
| 2-Nitropropane (CS) 7.68 |
| N-Pentylveratramine 7.28(+1) |
| Phenosulsulfonephthalein 7.9 |
| 3-Pheny-.alpha.-analine, methyl ester 7.05 |
| N-Propylveratramine 7.20(+1) |
| Pyrocatecholsulfonephthelein 7.82 |
| Serine, methyl ester 7.03(+1) |
| Solanine 7.34(+1) |
| Sylvic acid (Abietic acid) 7.62 |
| 2,3,5,6-Tetramethylpyridine 7.90(+1) |
| Thebaine 7.95(+1) |
| 3-Thio-S-methylcarbizide 7.56(+1) |
| 1,3,5-Triazine-2,4,6-triol 7.20 |
| 2,4,5-Trichlorophenol (CS) 7.37 |
| 3,4,5-Trichlorophenol 7.84 |
| Triethanolamine 7.76(+1) |
| 2,3,6-Trimethylpyridine 7.60(+1) |
| 2,4,6-Trimethylpyridine (2,4,6-Collidine 7.43(+1) |
| Tris(2-hydroxyethyl)amine 7.76(+1) |
| 2-[Tris(hydroxymethyl)methylami- no]-1-ethansulfonic acid 7.50 |
| (TES) Tyrosine amide 7.48 |
| Tyrosine, ethyl ester 7.33 |
| Uridine-5'-diphosphoric acid 7.16 |
| L-Valine, methyl ester 7.49(+1) |
| Vetramine 7.49(+1) |
| Vitamin B12 7.64(+1) |

+1 after the $pk_a$ denotes that the acid is the protonated base; $BH^+ \leftrightarrows B + H^+$, $k_a = [B][H^+]/BH^+$ The absence of a +1 after the $pk_a$ denotes a normal acid dissociation; $BH \leftrightarrows B^- + H^+$, $k_a = [B^-][H^+]/[BH]$ Water is present in the buffered fluoride containing compositions. It can be present coincidentally as a component of other elements of the invention such as aqueous ammonium fluoride solution or an aqueous buffer solution, or it can be added separately. Water is present in amounts of from 1% by weight to 92% by weight, or in amounts of from 1% to 70% by weight of the total composition. The presence of water improves the solubility of ammonium fluoride in the fluoride containing compositions of the invention as well as improving the ability to remove inorganic etch residues.

In addition, the aqueous, buffered, fluoride containing compositions can further contain an organic, polar solvent miscible in water. The organic polar solvents miscible in water are those solvents typically used in formulations for stripping and cleaning applications. Examples of acceptable organic polar solvents include a sulfoxide such as dimethylsulfoxide (DMSO), a sulfone such as dimethyl sulfone, an amine such as monoethanolamine (MEA), triethanolamine (TEA) or N-methyl ethanolamine (NMEA), an amide such as formamide or dimethylacetamide (DMAC), a lactone such as gamma-butyrolactone, a pyrrolidone such as N-methylpyrrolidone (NMP), an imidazolidinone such as 1,3-diethyl-2-imidazolidinone, a glycol such as polyethylene glycol (PEG) or ethylene glycol monobutyl ether and the like. DMAC is a preferred organic polar solvent. If present, the organic polar solvent is added in amounts up to 70% by weight based on the total weight of the composition.

Other components such as corrosion inhibitors can be added to the aqueous, buffered fluoride containing compositions. If present, the corrosion inhibitors are added in an amount up to 20% by weight of the total weight of the composition. Preferably the corrosion inhibitors are present in amounts of from 1% by weight to 5% by weight. Examples of suitable corrosion inhibitors includes benzotriazole, gallic acid, catechol, pyrogallol and esters of gallic acid. Benzotriazole functions both as an inhibitor and a weak acid in a buffer solution.

The aqueous, buffered fluoride containing compositions are able to maintain their pH even after contamination with acidic or caustic media. Unlike unbuffered fluoride containing compositions that are subject to drifting pH, the buffered compositions of the present invention can maintain their pH related performance characteristics such as reduced oxide etch rate, reduced metallic and electrogalvanic corrosiveness and cleaning efficacy for longer periods of time. Having thus described the invention the following examples are provided for illustrative purposes and are not to be construed as limiting in nature. All amounts are given in weight percent unless otherwise noted. pH measurements are made on 5% aqueous solutions at room temperature. Metal etch rates were determined using a CDE ResMap 273 Four Point Probe (E-M-DGLAB-0007). 500 mls of test solution was placed in a 600 ml beaker with stirring and heated, if required to the specified temperature. If the metal to be tested was titanium an initial dip in phosphoric acid was required. The initial thickness of a wafer was determined using the CDE ResMap 273 Four Point Probe. After determining the initial thickness, test wafers were immersed in the test solution. If only one test wafer was being examined a dummy wafer was added to the solution. After five minutes the test wafers were removed from the test solution, rinsed for three minutes with deionized water and completely dried under nitrogen. If a negative stripper solution was used an intermediate rinse of the test wafer in a solvent such as DMAC or IPA (isopropyl alcohol) was performed for three minutes prior to the water wash. The thickness of each wafer was measured and if necessary the procedure was repeated on the test wafer.

Oxide etch rates were determined using a Nanospec AFT 181 (E-M-DGLAB-0009). 200 mls of a test solution was placed in a 250 ml beaker with stirring and heated, if required, to the specified temperature. Three circles were scribed on each of the wafers to be tested. The marked areas on each wafer were the areas in which measurements would be taken. Initial measurements of each wafer were taken. After the initial measurements the wafers were immersed in the test solution for five minutes. If only one wafer was placed in a beaker containing solution a dummy wafer was placed in the beaker. After five minutes, each test wafer was washed with deionized water for three minutes and dried under nitrogen. If a negative stripper solution was used DMAC, IPA or another suitable solvent was used to rinse the test wafers for three minutes prior to the water rinse. Measurements of the scribed areas on each wafer were taken and if necessary the procedure was repeated.

EXAMPLE 1

A buffered fluoride-containing composition was prepared using vanillin (4-hydroxy-3-methoxy benzaldehyde) and $NH_4OH$. Vanillin has a $pk_a$ of 7.40. To ensure the concentration of the acid (vanillin) and the base are equal the molarity of $NH_4OH$ was half the molarity of the acid. All the components were mixed in a vessel with stirring.

| Component | Amount |
|---|---|
| DMAC | 64.05 |
| DI Water | 28.90 |
| Vanillin | 4.00 |
| $NH_4OH$ (28% $NH_3$ sol) | 0.80 |
| $NH_4F$ (40% sol) | 1.25 |
| Benzotriazole | 1.00 |

The calculated pH for the solution was 7.39. The measured pH for the formulation was as follows:

| Time (days) | Temp (° C.) | Measured pH |
|---|---|---|
| 0 | 25 | 7.26 |
| 1 | 21 | 6.81 |
| 2 | 21 | 6.29 |
| 3 | 21 | 4.82 |
| Change | N/a | 2.44 |

EXAMPLE 2

A solution was prepared in the same manner as Example 1

| Component | Amount |
|---|---|
| DMAC | 51.70 |
| DI Water | 35.00 |
| Vanillin | 4.00 |
| $NH_4OH$ (28% $NH_3$ sol) | 0.80 |
| $NH_4F$ (40% sol) | 7.50 |
| Benzotriazole | 1.00 |

The calculated pH for the solution was 7.28. The measured pH for the formulation was as follows:

| Time (days) | Temp (° C.) | Measured pH |
|---|---|---|
| 0 | 25 | 7.25 |
| 1 | 20 | 6.86 |
| 2 | 21 | 6.42 |
| 3 | 21 | 5.87 |
| Change | N/a | 1.38 |

EXAMPLE 3

The compositions of Examples 1 and 2 were heated in an open vessel for three hours at 40° C. The pH of each of the solutions changed by about 0.6 pH units.

| Time (hrs) | Example 1 | Example 2 |
|---|---|---|
| 0 | 7.34 | 7.19 |
| 3 | 6.73 | 6.58 |
| Change | 0.61 | 0.61 |

EXAMPLE 4

A solution was prepared in the same manner as in Example 1.

| Component | Amount |
|---|---|
| DMAC | 49.65 |
| DI Water | 35.00 |
| HEPES | 6.00 |
| $NH_4OH$ (28% $NH_3$ sol) | 0.85 |
| $NH_4F$ (40% sol) | 7.50 |
| Benzotriazole | 1.00 |

The calculated pH value was 7.43. The measured pH value was 7.34.

EXAMPLE 5

A solution was prepared in the same manner as Example 1.

| Component | Amount |
|---|---|
| DMAC | 62.00 |
| DI Water | 28.90 |
| HEPES | 6.00 |
| $NH_4OH$ (28% $NH_3$ sol) | 0.85 |
| $NH_4F$ (40% sol) | 1.25 |
| Benzotriazole | 1.00 |

The calculated pH value was 7.48. The measured pH value was 7.51.

EXAMPLE 6

Comparative (Unbuffered)

A solution was prepared in the same manner as Example 1.

| Component | Amount |
|---|---|
| DMAC | 67.50 |
| DI Water | 30.00 |
| $NH_4OH$ (28% $NH_3$ sol) | 0.30 |
| $NH_4F$ (40% sol) | 2.50 |

Additional ammonium hydroxide was added to raise the initial pH value to 8.3.

EXAMPLE 7

Figure 2:
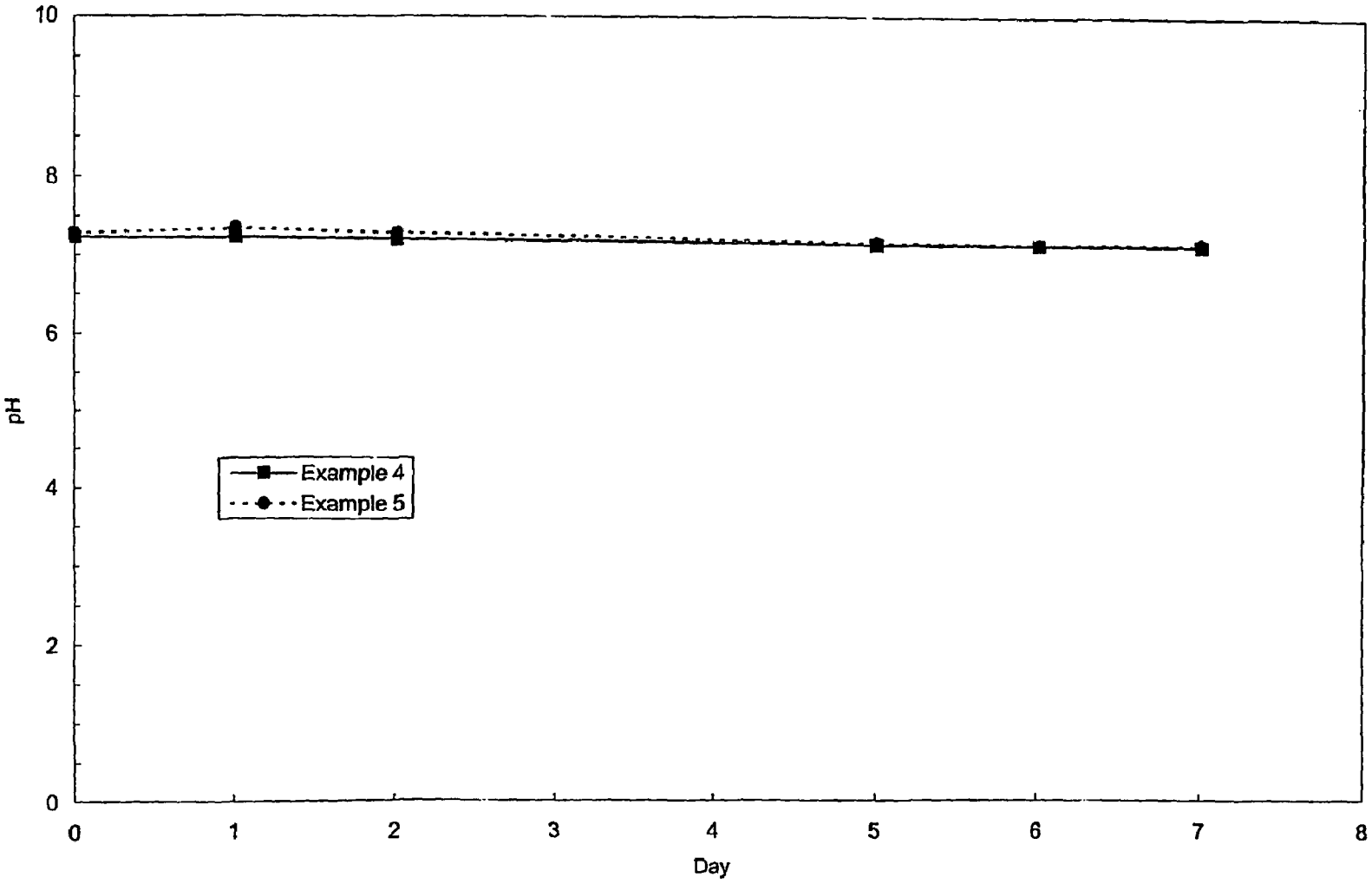
FIG. 2—A graph showing the change in pH on standing of a buffered, fluoride containing composition of the present invention.

The compositions of Examples 4 and 5 were allowed to set in open vessels at 25° C. for seven days. During this time the pH values of the buffered compositions of examples 4 and 5 were monitored. The results are shown in FIG. 2. The composition of Example 6 was treated in the same manner as Examples 4 and 5. The pH for the buffered samples remained relatively unchanged with a pH change of less than 0.25 pH units over the seven day period. By contrast, the unbuffered example had a pH change of greater than 4 pH units over the seven day period.

EXAMPLE 8

Figure 3:
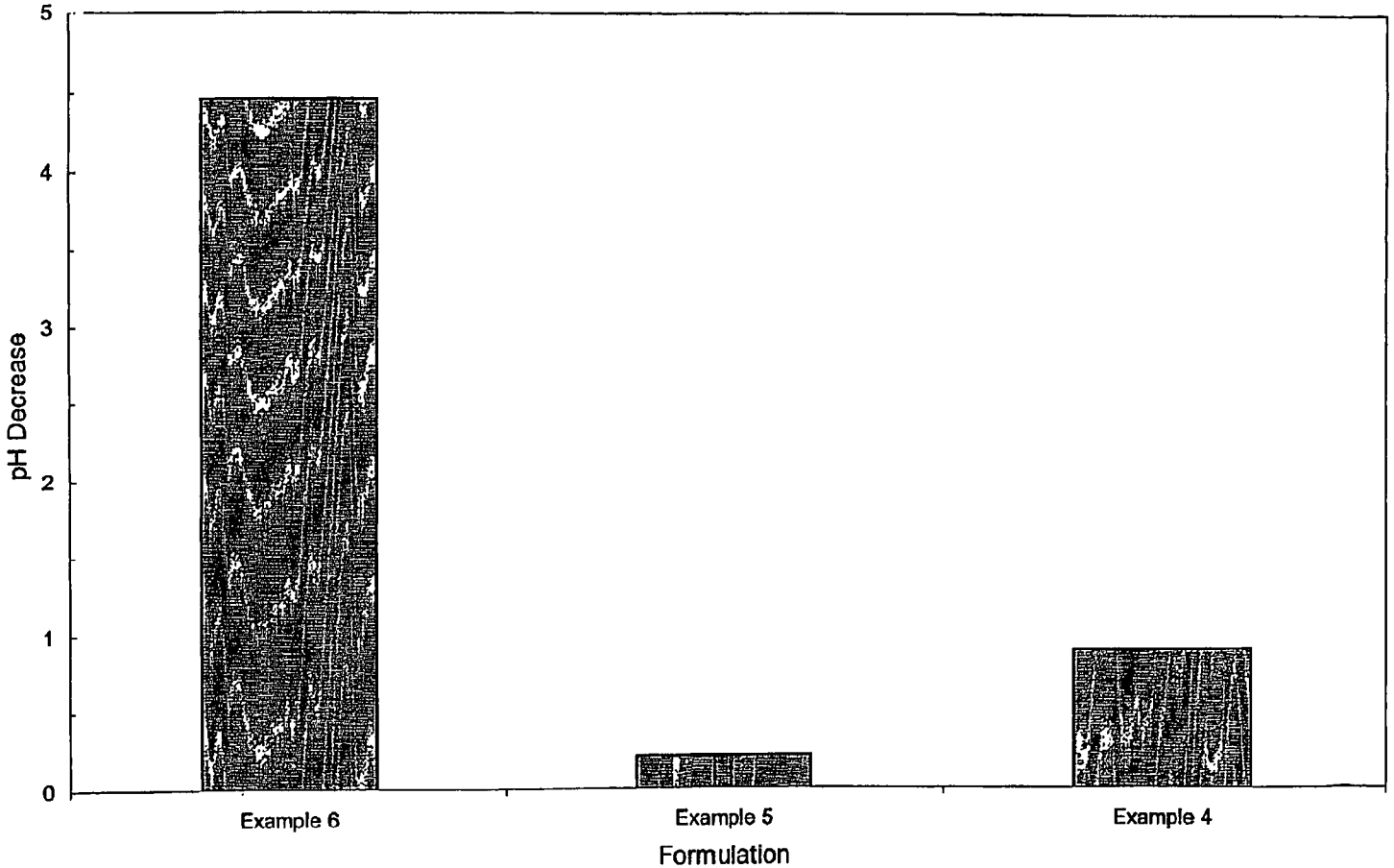
FIG. 3—A bar graph showing the decrease in pH of an unbuffered and two buffered samples on heating at 40° C. for three hours.

Examples 4, 5 and 6 were heated at 40° C. for three hours and the pH values were determined. The results are shown in FIG. 3. The unbuffered composition had a decrease in pH value of more than 4 units, while buffered examples 4 and 5 had decreases in pH of no more than 1 unit.

EXAMPLE 9

Figure 4:
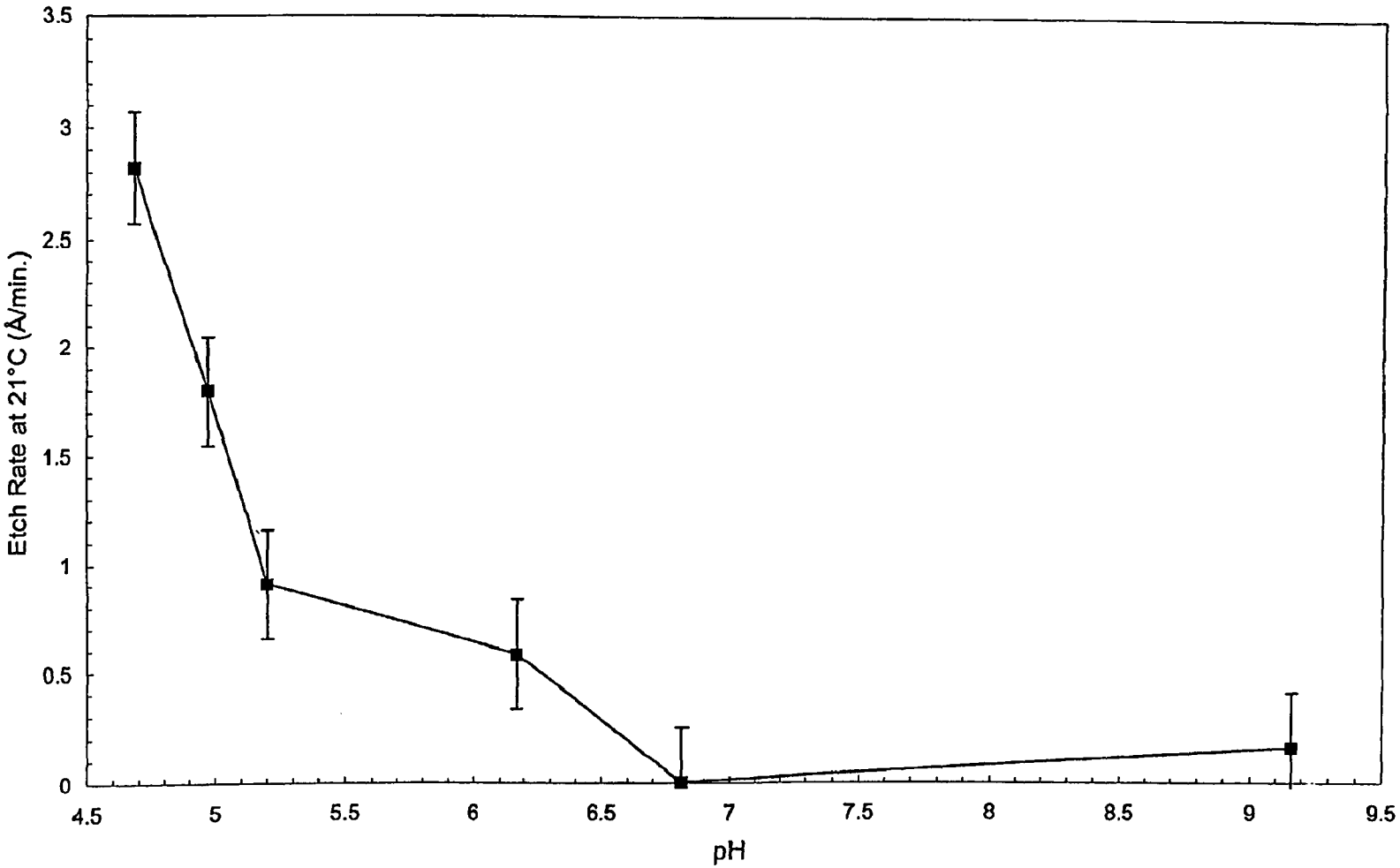
FIG. 4—A graph showing the change in TEOS etch rate of an unbuffered fluoride stripping/cleaning composition with changes in pH.

This example demonstrates how the oxide etch rate varies as a function of pH. For this procedure a weak base was added to adjust the pH upward to about 9.3. The pH was altered by diluting samples of the composition of example 6 so that the composition was 95% by weight of DI water. Oxide etch rates were determined optically on a Nanospec ATF using the standard procedure E-M-DGLAB-0009. The etch rate study was run with test wafers consisting of TEOS (tetraethyl ortho silicate) on silicon. Results are shown in FIG. 4.

EXAMPLE 10

Figure 5:
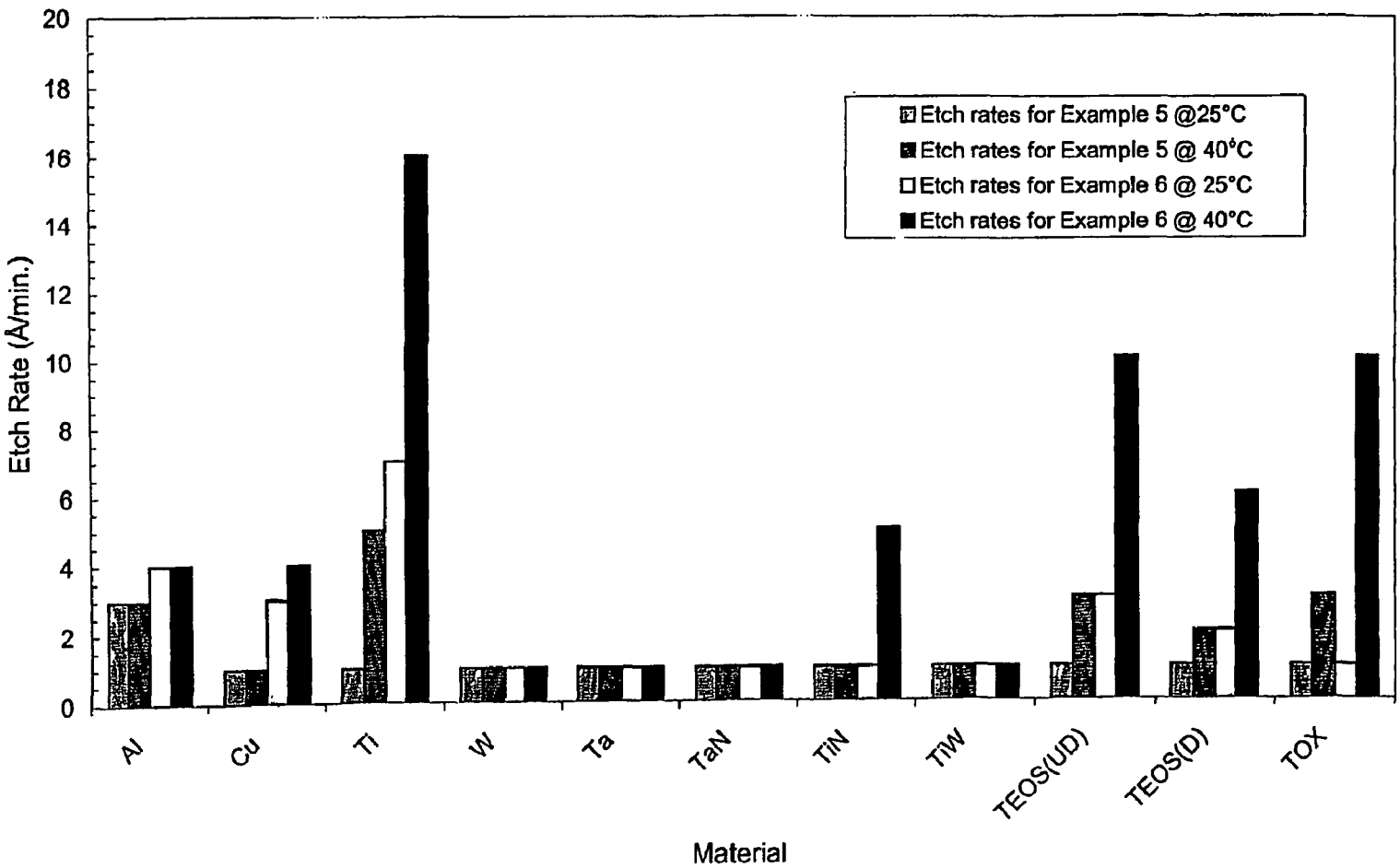
FIG. 5—A bar graph showing the etch rates of various metals when exposed to an acidic fluoride containing composition and a buffered near neutral fluoride composition.

Differences in etch rates of various metals for Examples 5 and 6 were determined. The metals included Al/Cu(4%), Cu, Ti, W, Ta, TaN, TiN, TiW, undensified TEOS, densified TEOS, and thermal dioxide. Metal etch rates were determined using a CDE ResMap 273 and a standard procedure E-M-DGLAB-0007, CDE ResMap 273 Four Point Probe Etch Rate. Test wafers consisted of the appropriate metal on $SiO_2$ on silicon. Results are shown in FIG. 5.

EXAMPLE 11

Differences in etch rates of the metals Al/Cu(4%) and Cu for Examples 1 and 2 were determined using the method disclosed in Example 10 at a temperature of 25° C. Test wafers consisted of the appropriate metal on $SiO_2$ on silicon. Results are provided as follows:

| Metal | Example 1 Etch Rate (Å/min.) | Example 2 Etch Rate (Å/min.) |
|---|---|---|
| Al/Cu (4%) | 6 | 10 |
| Copper | 3 | 1 |

The invention claimed is:

1. A composition for cleaning a semiconductor substrate, the composition comprising:

a fluoride containing compound selected from a fluoroboric acid; a compound of the general formula $R_1R_2R_3R_4NF$, where $R_1$, $R_2$, $R_3$ and $R_4$ are independently hydrogen, an alcohol group, an alkoxy group or an alkyl group; and mixtures thereof, a buffer comprising a substantially 1:1 molar ratio of (A) an acid selected from a weak acid and a protonated base and (B) a base selected from an amine, ammonia, ammonium hydroxide and an alkyl ammonium hydroxide, and optionally an organic polar solvent wherein the solvent is miscible in water wherein the composition has a pH that ranges from greater than 7.0 to about 11.0.

2. The composition of claim 1 further comprising a corrosion inhibitor.

3. The composition of claim 1 wherein the fluoride containing compound is the compound of the general formula $R_1R_2R_3R_4NF$.

4. The composition of claim 3 wherein the compound is ammonium fluoride, tetramethyl ammonium fluoride, or tetraethyl ammonium fluoride.

5. The composition of claim 1 wherein the buffer comprises the weak acid selected from abietic acid, aspartic diamide, aspidospermine, N,N-bis(2-hydroxylethel)-2-aminoethane sulfonic acid, 4-chloro-2-(2'-thiazolylazo)phenol, chrome dark blue, diacetylacetone, 5,5-diallybarbituric acid, 1,3-dichloro-2,5-dihydroxybenzene, 2,3-dichlorophenol, 3,4-dihydroxybenzaldehyde, 2,6-dihydroxypurine, 1,10-dimethoxy-3,8-dimethyl-4,7-phenanthroline, N,N'-dimethylethylenediam-ine-N,N'-diacetic acid, dimethylhydroxytectracycline, 2,6-dimethyl-4-nitrophenol, ethyl-2-mercaptoacetate, 5-ethyl-5-pentylbarbituric acid, 5-ethyl-5-phenylbarbituric acid, glycine hydroxamic acid, hexamethyldisilazane, 1,2,3,8,9,10-hexamehtyl-4,7-phenathroline, 4-hydroxybenzaldehyde, 4-hydroxybenzonitrile (4-cyanophenol), 10-hydroxycodeine, N-(2-hydroxyethyl) piperazine-N'-ethansulfonic acid ("HEPES"), 5-hydroxy-2-(hydroxymethyl)-4H-pyran-4-one, 2-hydroxy-3-methoxybenzaldehyde, 4-hydroxy-3-methoxybenzaldehyde, 3-hydroxy-4-nitrotoluene, 4-methoxy-2-(2'-thiazoylazo) phenol, 2,2'-methylenebis(4-chlorophenol), 4-(methylsulfonyl)phenol, methylthioglycolic acid, 1-methylxanthine, 3-(N-morpholino)propanesulfoni-c acid, 2-nitrohydroquinone, 2-nitrophenol, 4-nitrophenol, 2-nitropropane, phenosulsulfonepthalein, 3-pheny-.alpha.-analine methyl ester, pyrocatecholsulfonepthelein, sylvic acid, 1,3,5-triazine-2,4,6-triol, 2,4,5-trichlorophenol, 3,4,5-trichlorophenol, 2-[tris (hydroxymethyl)methyl-lamineo]-1]ethansulfonic acid, tyrosine amide, tyrosine ethyl ester, uridine-5-diphosphoric acid, benzotriazole, and mixtures thereof.

6. The composition of claim 5 wherein the weak acid is selected from HEPES, benzotriazole, and mixtures thereof.

7. The composition of claim 1 wherein the buffer comprises the protonated base selected from alanine methyl ester, 2-aminoacetamide, 4-amino-3-bromomethylpyridine, 2-aminobutanoic acid methyl ester, 1-aminoisoquinoline, 4-aminoisoxazolidine-3-one, 2-amino-3-methylpyridine-, 2-amino-4-methylpyridine, 2-amino-5-methylpyridine, 2-amino-6-methylpyridine, 2-aminoquilone, n-tert-butanaline, codeine, 2-cyanoethylamine, 2-cyclohexyl-2-pyrroline, N,N-diethyl-o-toluidine, dihydroergonovine, N,N'-dimethyl-p-toluidine, emetine, ergometrinine, 2-ethyl-2-pyrroline, N-ethylveratramine, glycine ethyl ester, glycine methyl ester, glyoxaline, harmine, heroin, isopilocarpine, leucine amide, leucine ethyl seater, methoxycarbonylmethylamine, 1-methylimidazole, 4-methylimidazole, N-methylmorpholine, morphine, N-pentylveratriamine, N-propylveratriamine, serine methyl ester, solanine, 2,3,5,6-tetramethylpyridine, thebaine, 3-thio-5-methylcarbizide, triethanolamine, 2,3,6-trimethylpyridine, 2,4,6-trimethylpyridine, tris(2-hydroxyethyl) amine, L-valine methyl ester, vetramine, vitamin $B_{12}$, and mixtures thereof.

8. The composition of claim 1 comprising an organic, polar solvent.

9. The composition of claim 8 wherein the solvent is one selected from an amine, a sulfoxide, a sulfone, an amide, a lactone, a pyrrolidone, an imidazolidinone, a glycol, a glycol ether and mixtures thereof.

10. The composition of claim 9 wherein the solvent is dimethylacetamide.

11. The composition of claim 9 wherein the solvent is N-methylpyrrolidone.

12. The composition of claim 1 wherein the pH ranges from greater than 7.0 to about 9.0.

13. The composition of claim 12 wherein the pH ranges from greater than 7.0 to about 8.4.

14. An aqueous, buffered fluoride-containing composition, comprising:

from 0.1% by weight to 20% by weight of a fluoride containing compound selected from fluoroboric acid; a compound of the general formula $R_1R_2R_3R_4NF$, where $R_1$, $R_2$, $R_3$ and $R_4$ are independently hydrogen, an alcohol group or an alkyl group; and mixtures thereof, up to 70% by weight of an organic polar solvent wherein the solvent is miscible water, a buffer comprising, in substantially a 1:1 molar ratio, (A) an acid selected from a weak acid and a protonated base and (B) a base selected from an amine, ammonia, ammonium hydroxide and an alkyl ammonium hydroxide, and from 1% by weight to 92% by weight water, wherein the aqueous, buffered, fluoride containing composition has a pH that ranges from greater than 7.0 to about 11.0.

15. The aqueous, buffered, fluoride containing composition of claim 14 wherein the water is present in amounts ranging from 1% by weight to 70% by weight.

16. A composition for cleaning a semiconductor substrate, the composition comprising:

a fluoride containing compound selected from a fluoroboric acid; a compound of the general formula $R_1R_2R_3R_4NF$, where $R_1$, $R_2$, $R_3$ and $R_4$ are independently hydrogen, an alcohol group, an alkoxy group or an alkyl group; and mixtures thereof, a buffer comprising, in a molar ratio of about 10:1 to about 1:10, (A) an acid selected from a weak organic acid, a protonated base, and mixtures thereof and (B) a base selected from an amine, ammonia, ammonium hydroxide, an alkyl ammonium hydroxide, and mixtures thereof, and optionally an organic polar solvent wherein the solvent is miscible in water wherein the composition has a pH that ranges from greater than 7.0 to about 11.0.

17. A method of stabilizing oxide and metallic etch rates of an aqueous, fluoride containing composition, the method comprising:

providing the composition comprising a fluoride containing compound selected from fluoroboric acid; a compound of the general formula $R_1R_2R_3R_4NF$, where $R_1$, $R_2$, $R_3$ and $R_4$ are independently hydrogen, an alcohol group or an alkyl group; and mixtures thereof; and an organic polar solvent;

adding a buffer to the composition to adjust the pH of the composition to a range of from greater than 7.0 to about 11.0 wherein the buffer comprises, in substantially a 1:1 molar ratio, (A) an acid selected from a weak acid, a protonated base, and mixtures thereof and (B) a base selected from an amine, ammonia, ammonium hydroxide, an alkyl ammonium hydroxide, and mixtures thereof.

18. A method of stabilizing oxide and metallic etch rates of an aqueous, fluoride containing composition, the method comprising:

providing the composition comprising a fluoride containing compound selected from fluoroboric acid; a compound of the general formula $R_1R_2R_3R_4NF$, where $R_1$, $R_2$, $R_3$ and $R_4$ are independently hydrogen, an alcohol group or an alkyl group; and mixtures thereof; and optionally an organic polar solvent;

adding a buffer to the composition to adjust the pH of the composition to a range of from greater than 7.0 to about 11.0 wherein the buffer comprises, in a molar ratio of about 10:1 to about 1:10, (A) an acid selected from a weak organic acid, a protonated base, and mixtures thereof and (B) a base selected an amine, ammonia, ammonium hydroxide, an alkyl ammonium hydroxide, and mixtures thereof.

* * * * *

UNITED STATES PATENT AND TRADEMARK OFFICE

CERTIFICATE OF CORRECTION

PATENT NO. : 7,807,613 B2
APPLICATION NO. : 10/877305
DATED : October 5, 2010
INVENTOR(S) : Roberto J. Rovito, Jennifer M. Rieker and Darryl W. Peters It is certified that error appears in the above-identified patent and that said Letters Patent is hereby corrected as shown below:

Column 10, Line 25

In claim 5 delete "(hydroxymethyl)methyl-lamineo]" and insert -- (hydroxymethyl)methyl-amino] --

Column 10, Line 46

In claim 7 delete "3-thio-5-methylcarbizide" and insert -- 3-thio-S-methylcarbizide --

Signed and Sealed this

Twenty-third Day of November, 2010

David J. Kappos

David J. Kappos
*Director of the United States Patent and Trademark Office*